US005357642A

United States Patent [19]

Clute

[11] Patent Number: 5,357,642

[45] Date of Patent: * Oct. 25, 1994

[54] SUPPORT PILLOW WITH AUDIO COMFORTER

[76] Inventor: L. Jason Clute, 3555 Shadow Creek Dr., Danville, Calif. 94506

[ * ] Notice: The portion of the term of this patent subsequent to Mar. 16, 2010 has been disclaimed.

[21] Appl. No.: 93,889

[22] Filed: Jul. 20, 1993

[51] Int. Cl.[5] ..... A47D 13/08; A47D 15/00; A47G 9/00

[52] U.S. Cl. ..... 5/655; 5/632; 5/904

[58] Field of Search ..... 5/655, 904, 639, 631, 5/638, 639, 461, 468, 603, 630, 632

[56] References Cited

U.S. PATENT DOCUMENTS

| | | | |
|---|---|---|---|
| D. 343,756 | 2/1994 | Sher | 5/655 |
| 1,712,158 | 5/1929 | Neal | 5/639 |
| 2,562,725 | 7/1951 | Leto et al. | 5/930 |
| 2,962,731 | 12/1960 | Bounds | 5/639 |
| 3,124,812 | 3/1964 | Milton et al. | 5/638 |
| 3,292,611 | 12/1966 | Belkin | 5/101 |
| 3,924,282 | 12/1975 | Bond | 5/465 |
| 4,506,396 | 3/1985 | Ritchie, Jr. et al. | 5/631 |
| 4,733,836 | 3/1988 | Barnes | 5/639 |
| 4,862,438 | 8/1989 | Fry | 5/639 |
| 5,014,376 | 5/1991 | Doran et al. | 5/603 |
| 5,063,912 | 11/1991 | Hughes | 128/33 |
| 5,072,429 | 12/1991 | Mair | 5/639 |
| 5,165,130 | 11/1992 | Wendling | 5/655 |
| 5,182,828 | 2/1993 | Aliuizatos | 5/631 |
| 5,193,238 | 3/1993 | Clute | 5/655 |
| 5,216,772 | 6/1993 | Clute | 5/655 |

FOREIGN PATENT DOCUMENTS

| | | | |
|---|---|---|---|
| Des. 72427 | 7/1993 | Canada . | |
| 999217 | 7/1965 | United Kingdom | 5/639 |

*Primary Examiner*—Alexander Grosz

[57] ABSTRACT

An infant support pillow with a vibration inducer such as an audio emitter including two pad members defining a channel sized for supporting an infant generally on its side while sleeping. One of the pad members is structured for removably housing a electrically powered audio emitter. The audio emitter is structured for emitting a generated sound preferably similar to those sounds experienced by the infant when in the womb, and thereby promoting sleep.

2 Claims, 2 Drawing Sheets

SUPPORT PILLOW WITH AUDIO COMFORTER

BACKGROUND OF THE INVENTION

1. Field of the Invention

The present invention relates to support pillows and sleeping aids for humans in general, and in particular to a pillow which supports and maintains the torso of an infant generally stationary and primarily on its side while sleeping. The pillow also includes an audio or sound emitter specifically to comfort the infant and lure it to sleep.

2. Description of the Prior Art

The present invention is essentially an improvement in the inventions taught in my earlier patents, U.S. Pat. No. 5,216,772, issued on Jun. 8, 1993, and my U.S. Pat. No. 5,193,238 issued on Mar. 16, 1993. Both of my U.S. Pat. Nos. 5,216,772 and No. 5,193,238 are herein incorporated by reference, and this being for the teachings of the infant support pillows therein. The teachings of the possible various structuring for infant support pillows, the reasons for certain structuring, and the benefits to be gained thereby are detailed in the reference patents. The present invention is an inventive improvement adaptable to any one of or a combination of my infant support pillows of the reference patents, and essentially involves the modification of the support pillow to include an audio comforter to sooth and comfort, and thus lure an infant retained within my support pillow to sleep.

It has been found that many infants are comforted and soothed by certain vibrations which they sense audibly or feel, and will fall asleep faster, and remain asleep longer, when they sense these vibrations. Sounds associated with the prenatal environment, particularly repetitious sounds such as a human heart beat, are particularly comforting to infants presumably since they are reminiscent of life in the womb which was for the child, safe, warm and reassuring. There is also the theory that "grey noise", or sound which is low in volume but relatively consistent in pitch such as a motor, helps to drown out intermittent background noise which may wake up the infant. Gentle rocking movement or mild vibrations which the infant can feel have been found to help induce sleep, as most parents have found when transporting the infant in a vehicle.

Therefore it seems an ideal arrangement to include an infant support pillow for reducing the risk of SIDS as taught in the references patents with a vibration inducer such an audio or sound emitter specifically to comfort the infant and lure it to sleep. An ideal audio sound emitter would not have the disadvantages of cassette tape or audio disc play back units which require high electrical power consumption which quickly drains batteries in the physical rotation of the sound medium in order to play back the recorded message. Additionally, it does not seem to be an ideal arrangement to place such audio units with hard sharp edges in a crib with an infant especially when there is a chance of electrical shock if a high voltage power cord is used to power the play back machine. High as well as low voltage cords pose the hazard of an infant being strangled if used to power the play back machines within the crib. Placing the play back units outside the crib may require increasing the volume to an unacceptable level for others in the same room. Tapes and discs are also a disadvantage in that they can become misplaced or worn-out.

SUMMARY

The following written description of the present invention is intended to illustrate the invention by way of example and is not intended to overly limit the invention, as modifications to that which is described may clearly be made without departing from the true scope of my invention.

The present invention provides a support pillow generally in accordance with any one of my support pillows of the referenced patents for supporting an infant primarily on its side at least in a semi-lateral position, with the pillow structured for removably retaining a vibration inducer such as an audio emitter structured for producing sounds for comforting the infant. Each main section of the pillow is structured of an elongated triangular shaped resilient pad preferably covered with a soft, thin, flexible material.

The pillow is structured with an interior chamber sized for removably housing a small audio emitter. A rectangular recess or depression is formed on the central bottom section of pad section sized for retaining the housing of the audio emitter. An elongated slit or opening in the exterior fabric covering along the outside lengthwise edge of the pillow allows for passage of the audio emitter and for access to the controls for regulating the emitted sound. The bottom of the audio emitter is supported within the chamber by the fabric covering of the pillow which helps maintain it in position. Since the audio emitter is sized slightly larger than the chamber, the natural resiliency of the preferred material within the pad, i.e. foam rubber, also helps to snugly retain the emitter. Therefore, the audio emitter is safely housed within the pillow, with all hard or sharp edges covered for the infant's protection, and with no separate units to lose or misplace.

The audio emitter is basically comprised of a small rectangular housing approximately two and one half inches wide, three inches long and three fourths of inch in thickness. The audio emitter preferably includes an on/off switch, a volume control switch, a speaker, a replaceable battery and solid state circuitry designed to generate and emit a specified sound via the speaker. The sounds emitted are preferably similar to those heard by the infant when in the womb, such as the mother's heart beat, although other sounds, such as music, can also be emitted. The sounds produced by the audio emitter are projected through the open cell foam padding of the pillow where they are heard by the infant. The sound projected through the foam pad also creates a mild vibration which can be felt by the infant. This minor vibration has also been found to be somewhat comforting to the infant, apparently due to the infant experiencing constant movement and various vibrations while in the womb. The sounds produced by the audio emitter can be programed for continuous play, but preferably is set to automatically end after a certain length of time as this will save power.

Other advantages of the invention include ease in portability, since the pillow is small, lightweight, and malleable it can be easily transported in a suitcase or diaper bag when traveling. The relatively small size of the pillow also allows it to be used in cradles or bassinets. Since the preferred audio emitter uses solid state circuitry to generate tones or sounds, much less power is required to operate it than a tape player, and therefore the batteries will last much longer. The housing of the audio emitter can also be structured much smaller in size and lighter in weight than a tape player. There is also no danger of a tape being misplaced or damaged since the sounds emitted from the audio emitter are inherently generated by the solid state circuitry each time it is played, and tapes and discs are never required. Since the audio emitter is in such close proximity to the infant, the sounds emitted from the audio emitter can be very low in volume and therefore will not disturb or annoy other people, even if they are sleeping in the same room. When the pillow becomes soiled, the audio emitter can be easily removed and the pillow washed.

The present support pillow with audio comforter therefore provides physical as well as emotional comfort for the infant which helps it to more easily fall asleep and remain asleep longer.

Other objects and advantages of the invention will become apparent after examining the remaining specification and claims with a comparison with the accompanying numbered drawings.

DESCRIPTION OF THE PREFERRED EMBODIMENT

Figure 1:
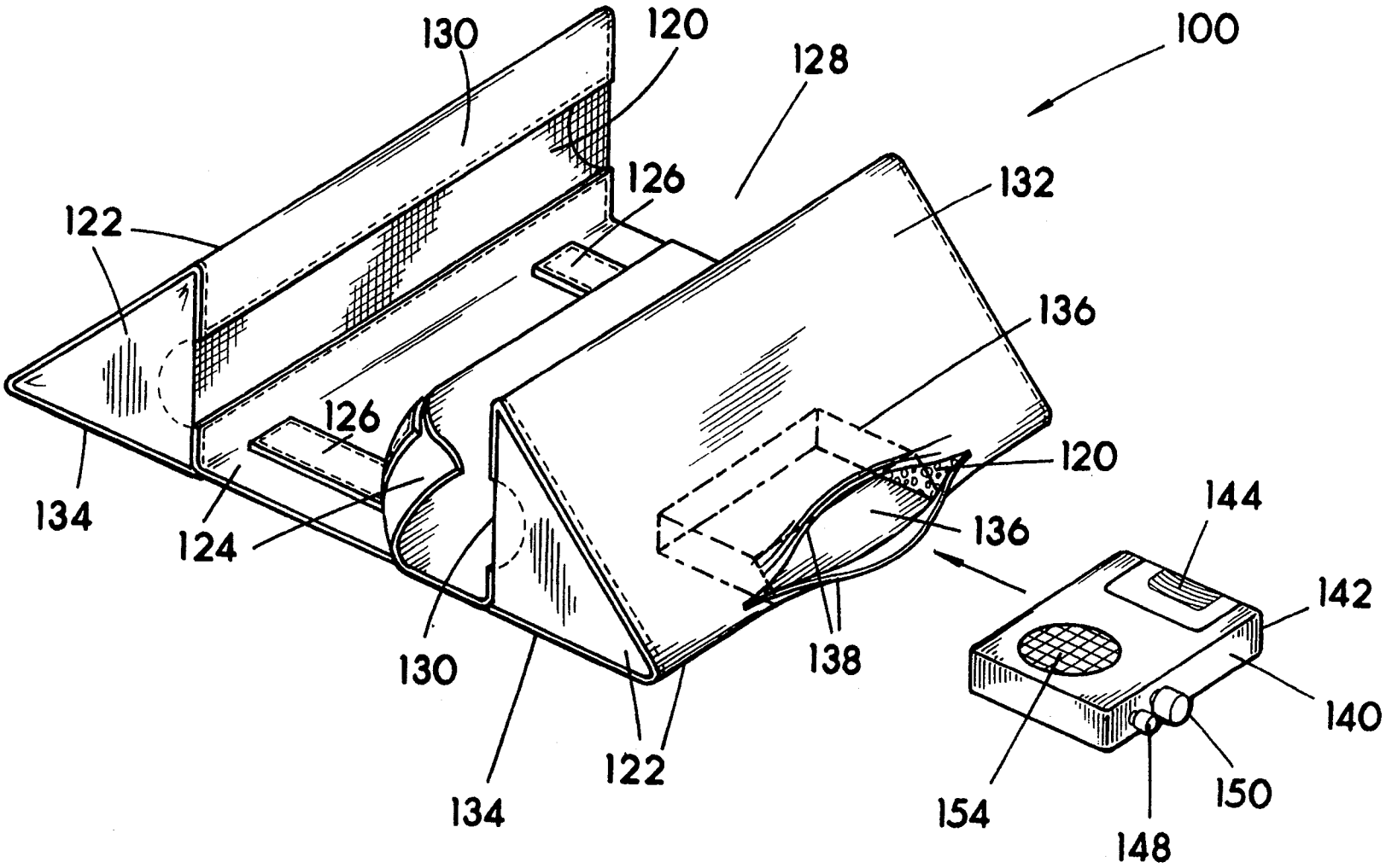
FIG. 1 being an example of one structural embodiment of the present invention given for example is a perspective top plan view of an infant support pillow showing an audio emitter positioned for insertion into the interior chamber of the pad.
Figure 2:
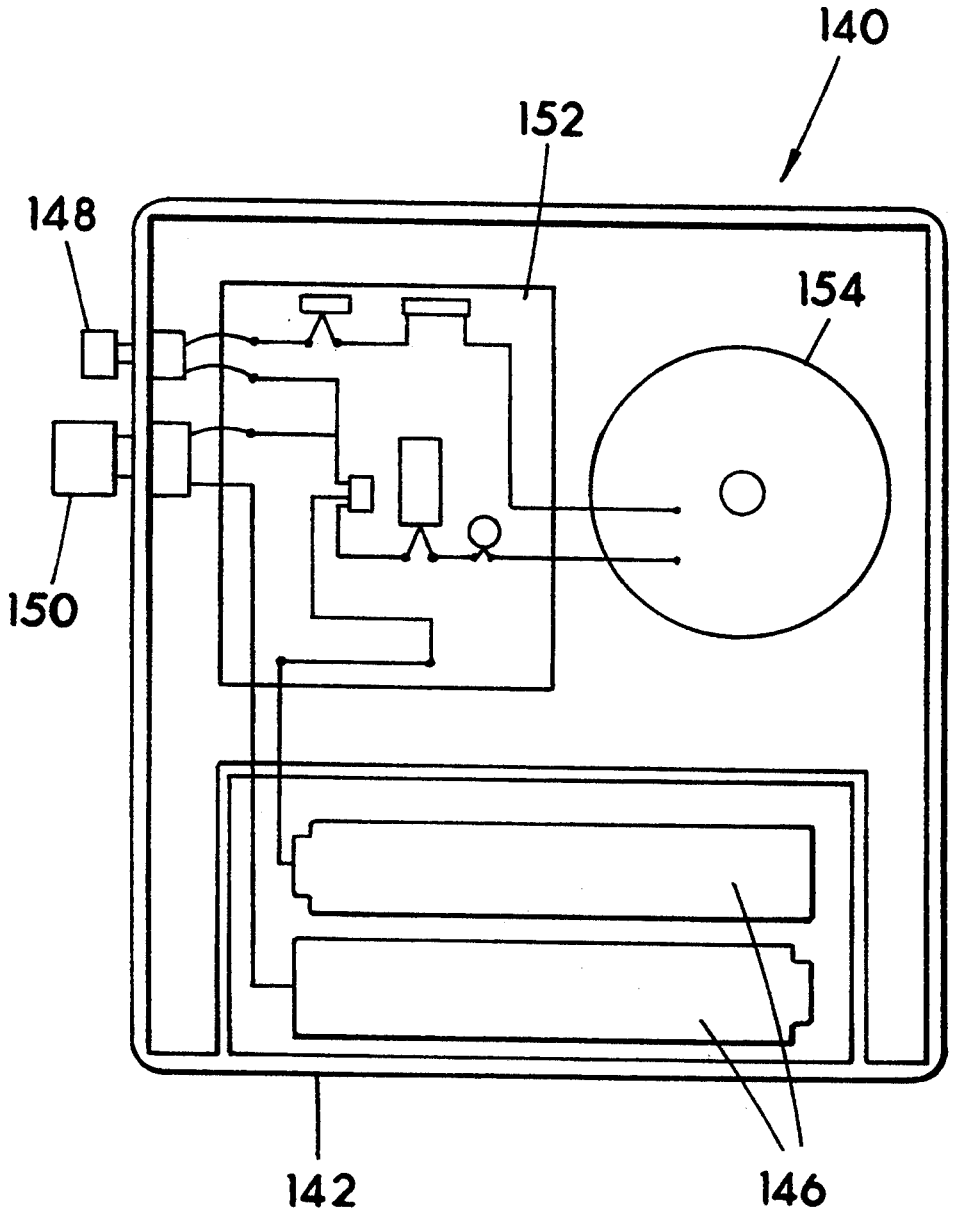
FIG. 2 is an illustrative interior view of the audio emitter of FIG. 1 showing various components.

Referring now to the drawings where a first embodiment of support pillow 100 is illustrated for example. Support pillow 100 may be structured in accordance with any of my infant support pillows of the reference patents. Support pillow 100 may be generally comprised of two similar main sections each of which include an elongated triangular foam member 120 enclosed in a fabric covering 122. Fabric covering 122 extends off one edge of each foam member 120 to form a flat rectangular panel 124. Each panel 124 is structured for releasable overlapping attachment to one another, preferably with hook and loop fasteners 126. Once panels 124 are properly affixed to one another, a central U-shaped channel 128 is formed between the two sections. The U-shaped channel 128 is sized and structured for securely supporting an infant on its side while sleeping.

Each section of foam members 120 is basically structured with a longitudinal vertical side wall 130, both of which are positioned parallel to one another when pillow 100 is assembled. Each foam member 120 also includes a longitudinal angled side wall 132 and a longitudinal horizontal base 134. The vertical side walls 130 of each foam member 120 may include an optional feature of an air ventilation recess which is structured for cooling the infant and also to provide a breathing recess should the infant's face become pressed up against the vertical side wall 130. One embodiment of the ventilation recess is shown in FIG. 1 as a semi-circular longitudinal groove in vertical side wall 130 covered with a fine open weave material.

Incorporated into the central horizontal base 134 of one foam member 120 is a recess or depression, preferably essentially the same shape as the exterior of audio emitter 140, which in combination with covering 122, defines an interior chamber 136. Chamber 136 extends from the exterior of angled side wall 132 of the foam member 120 to adjacent, but not through, to vertical side wall 130 which faces the U-shaped channel 128. Chamber 136 is therefore open along angled side wall 132 and along horizontal base 134. Covering 122 extends over horizontal base 134 of foam member 120, thereby enclosing chamber 136 on that surface. Covering 122 also extends over the opening of chamber 136 which is located on the lower lengthwise edge of angled side wall 132 of foam member 120, and is incorporated with an elongated opening or slit 138. Slit 138 is similar in structure to a conventional button hole, except much larger. Slit 138 is slightly longer in length than the width of chamber 136 which allows slit 138 to be opened sufficiently for passage of audio emitter 140 therethrough into chamber 136. Chamber 136 is sized and structured for removable but snug insertion of audio emitter 140.

Audio emitter 140 is basically comprised of a rectangular plastic housing 142 having a battery compartment with openable door 144 for insertion and replacement of batteries 146, and an on/off button 148 affixed to one narrow elongated edge, for initiating the emission of the audible sounds or music. A volume control knob 150 is also positioned adjacent the on/off button 148 for raising or lowering the volume as desired. The functions of on/off and volume control could of course be combined into a single control knob if desired. The interior of housing 142 contains solid state circuitry 152 structured for creating a sound signal which is emitted through audio speaker 154 as an audible tone. Solid state circuitry 152 is connected to battery 146, speaker 154, on/off button 148 and volume control knob 150 with the appropriate conductors. Batteries, or at least one battery is the preferred form of electrical power for audio emitter 140 for safety reasons, although the emitter 140 would operate on power cords. Solid state circuitry 152 may be a simple tone signal generating circuit using discrete components on a circuit board which outputs an analog signal to an amplifier to drive speaker 154, and this simple arrangement may be the repetitious build-up and discharge of the same tone signal, or a continuous tone. An off-delay timer is preferably built into the circuit so that the tone signal generating will cease after a preset period of time, wherein the on/off switch could be used to reset the timer. Solid state circuitry 152 may also be a more complicated circuit arrangement using digital signal generation using flash memory RAM and a digital to analog converter in front of the amplifier for driving the audio speaker 154. Using non-volatile digital memory and tone signal generation therefrom, will provide for more accurate and controllable sounds if attempting to accurately simulate the sound of the mother's heartbeat that the infant grew accustomed to when in the womb.

When audio emitter 140 is inserted into chamber 136, volume control knob 150 and on/off button 148 are positioned extending through slit 138 in covering 122 where they are accessible for use. Speaker 154 should be positioned upward for emission of the sounds towards the infant. Slit 138 can be structured with overlapping edges which cover on/off button 148 and volume control knob 150 if desired, for increased protection of the infant.

Although speaker 154 actually outputs low level vibration which is most easily heard but can be felt depending upon the volume setting, additional vibration may be obtained by way of adding a small electric motor, preferably into the housing audio emitter 140, and connecting an off-centered weight to the rotary shaft of the motor. This motor and weight will increase the infant's sense of vibration, but if batteries are used as the power source, the motor will greatly increase the rate of power consumption over the audio circuitry alone.

The detailed description of the invention is to be considered illustrative and for example, and not intended to limit the scope thereof, as those skilled in the art will quickly recognize many changes in shapes, sizes, relative positions, materials, etc, may be made to that which is herein described and shown in the drawings without departing from the true scope of the invention.

What I claim as my invention is:

1. A support pillow with audio comforter structured for maintaining a human infant primarily on its side and for emitting sound to aid in sleep, said support pillow comprising;

a first elongated member having at least one vertically oriented, generally planar, side wall connected to a base, a second elongated member having at least one vertically oriented, generally planar, side wall connected to a base, said support pillow including a channel, said channel having oppositely disposed vertically oriented sides defined by said side walls of the first elongated member and the second elongated member in spaced relationship to one another, the spacing between said side walls being sufficient for a human infant to lie between said side walls within said channel and to be maintained primarily on its side, said support pillow including means connecting between the bases of said first and second elongated member for allowing adjustments in the spacing between said side walls and thus in the width of said channel for accommodating differently sized human infants, said bases of said first and second elongated members in combination with said means connecting between the bases defining a generally flat anti-roll bottom on said support pillow for preventing a human infant within said channel from rolling said support pillow, sound producing and emitting means attached to said support pillow including tone generation means for audible broadcast by an audio speaker for emitting sound which is audible to a human infant when lying within said channel, said sound producing and emitting means being battery powered and lacking an electrical extension powering cord, said support pillow further including at least one of said elongated members having open means for providing air space, with said open means structured so as to prevent a human infant's nose and mouth from engaging said elongated member to a degree sufficient to significantly interfere with the infant's breathing in the event the infant is improperly placed on said support pillow.

2. A support pillow with audio comforter structured for maintaining a human infant primarily on its side and for emitting sound to aid in sleep, said support pillow comprising;

a first elongated member having at least one upward extending planar side wall connected to a base, a second elongated member having at least one upward extending planar side wall connected to a base, said support pillow including a channel, said channel having oppositely disposed upward extending planar sides defined by said side walls of the first elongated member and the second elongated member in spaced relationship to one another, the spacing between said side walls being sufficient for a human infant to lie between said side walls within said channel and to be maintained primarily on its side, said support pillow including means connecting between the bases of said first and second elongated members for allowing adjustments in the spacing between said side walls and thus in the width of said channel for accommodating differently sized human infants, said bases of said first and second elongated members in combination with said means connecting between the bases defining a generally flat anti-roll bottom on said support pillow for preventing a human infant within said channel from rolling said support pillow, sound producing and emitting means attached to said support pillow including tone generation means for audible broadcast by an audio speaker for emitting sound which is audible to a human infant when lying within said channel, said sound producing and emitting means being battery powered and lacking an electrical extension powering cord, said support pillow further including at least one of said elongated members having open means for providing air space, with said open means structured so as to prevent a human infant's nose and mouth from engaging said elongated member to a degree sufficient to significantly interfere with the infant's breathing in the event the infant is improperly placed on said support pillow.

* * * * *